US007180470B1

(12) United States Patent
Hentosh

(10) Patent No.: US 7,180,470 B1
(45) Date of Patent: Feb. 20, 2007

(54) ENHANCED ANTENNA STOWAGE AND DEPLOYMENT SYSTEM

(75) Inventor: David J. Hentosh, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 2 days.

(21) Appl. No.: 11/002,581

(22) Filed: Dec. 3, 2004

(51) Int. Cl.
*H01Q 3/02* (2006.01)

(52) U.S. Cl. ..... 343/882; 343/DIG. 2

(58) Field of Classification Search ..... 343/DIG. 2, 343/882, 840, 915, 916; 244/172.6
See application file for complete search history.

(56) References Cited

U.S. PATENT DOCUMENTS 3,680,143 A * 7/1972 Ajioka et al. ..... 343/778
5,293,171 A * 3/1994 Cherrette ..... 343/700 MS
6,424,314 B1 * 7/2002 Baghdasarian et al. ..... 343/882
6,448,940 B1 * 9/2002 Chiang ..... 343/882
6,580,399 B1 * 6/2003 Ballinger et al. ..... 343/781 P

* cited by examiner

*Primary Examiner*—Michael C. Wimer
(74) *Attorney, Agent, or Firm*—McDermott Will & Emery LLP

(57) ABSTRACT

An antenna stowage and deployment system, including a spacecraft and at least one pair of adjacent nesting antenna assemblies. Each of the antenna assemblies further includes an articulating deployment couple affixed to the spacecraft for deploying the antenna assembly, a first antenna affixed to the deployment couple, and a second antenna affixed to the first antenna. The enhanced antenna stowage and deployment system according to the present invention permits the separation and orientation of more than two adjacent antennas which require an extremely precise deployed position relative to a main spacecraft body. As such, the deployment couple further includes a 1-axis separating hinge and/or a 2-axis primary deployment gimbal. At least one of the antenna assemblies further includes a 2-axis secondary deployment gimbal or a rigid connecting structure for affixing the second antenna to the first antenna.

14 Claims, 4 Drawing Sheets

ENHANCED ANTENNA STOWAGE AND DEPLOYMENT SYSTEM

STATEMENT AS TO RIGHTS TO INVENTIONS MADE UNDER FEDERALLY SPONSORED RESEARCH OR DEVELOPMENT

Not Applicable

FIELD OF THE INVENTION

The present invention generally relates to an enhanced antenna stowage and deployment system and, more particularly, relates to the deployment of a pair of adjacent, gimbaled and nested antenna assemblies each comprising multiple antennas.

BACKGROUND OF THE INVENTION

In the development of satellite technologies, antenna flexibility, configurability, and aperture size affect the types of missions which can be performed by the satellite and define the variety of environments in which the satellite can operate. As more exotic mission applications are developed, antennas and antenna deployment subsystems need to be optimized to specifically tailor satellites to particular missions.

As spacecraft capabilities and mission applications require increased information transmission capabilities, multiple large-aperture deployable antennas have been developed. Due to design limitations, antennas are conventionally stowed and deployed at different locations on a spacecraft when there are more than two antennas.

FIGS. 1A and 1B depict an example of a conventional antenna stowage and deployment system for a spacecraft with four antennas, in a stowed state and a deployed state, respectively. Specifically, conventional antenna stowage and deployment system 100 includes spacecraft 101, nesting antennas 102 to 105, and deployable appendages 107 and 108, where nesting antennas 102 to 105 are illustrated as reflectors. Nesting antennas 102 to 105 are affixed to spacecraft 101 via 1-axis hinges, including 1-axis hinges 106.

In the stowed state (FIG. 1A), 1-axis hinges 106 are in the retracted position, and nesting antennas 102 to 105 are stowed, minimizing the volume necessary to store conventional antenna stowage and deployment system 100 on a launch vehicle. In the deployed state (FIG. 1B), 1-axis hinges 106 are in a fully extended position, deploying nesting antennas 102 to 105 so that electronic signals emanating from associated unnumbered feeders can be reflected off deployed and oriented antennas 102 to 105, and directed to a receiver.

To its disadvantage, however, the conventional antenna stowage and deployment system utilizes nesting antennas 102 to 105 which are positioned on obverse sides of spacecraft 101, negatively affecting appendage flexibility and configurability, and reducing the number and types of missions which can be performed by the satellite.

Since conventional large antennas need to be tied down at launch, multiple equally-spaced launch restraints or tie-downs are typically used to prevent damage of antennas on conventional spacecraft. In FIG. 1, for example, launch restraints for nesting antennas 104 and 105 are located at launch restraint locations 110 to 113. Additional non-illustrated launch restraints are also required for nesting antennas 102 and 103.

Prior to deployment, launch restraints for each antenna are cut using, for example, small explosive charges. Since the antenna are conventionally located on obverse sides of a spacecraft, individual launch restraints and launch restraint severing mechanisms must be designed for each antenna. This further necessitates the inclusion of duplicitous launch restraint control mechanisms, increasing spacecraft volume and mass, and reducing overall mission capabilities.

It is therefore considered highly desirable to provide an improved antenna stowage and deployment system for a spacecraft with more than two antennas. In particular, it is desirable to provide an enhanced system which allows more than two antennas to be placed adjacently on a spacecraft, minimizing the volume of the system and reducing the number of necessary launch restraints.

SUMMARY OF THE INVENTION

The present invention generally relates to an enhanced antenna stowage and deployment system and, more particularly, relates to the deployment of a pair of adjacent, gimbaled and nested antenna assemblies each comprising multiple antennas.

According to one aspect, the present invention is an antenna stowage and deployment system, including a spacecraft and at least one pair of adjacent nesting antenna assemblies. Each of the antenna assemblies further includes an articulating deployment couple affixed to the spacecraft for deploying the antenna assembly, a first antenna affixed to the deployment couple, and a second antenna affixed to the first antenna.

The enhanced antenna stowage and deployment system according to the present invention permits the separation and orientation of more than two adjacent antennas which require an extremely precise deployed position relative to a main spacecraft body. As such, the deployment couple further includes a 1-axis separating hinge and/or a 2-axis primary deployment gimbal. At least one of the antenna assemblies further includes a 2-axis secondary deployment gimbal or a rigid connecting structure for affixing the second antenna to the first antenna.

At least one of the antenna assemblies further includes a third antenna affixed to the second antenna, where the third antenna comprises a center-fed antenna. The at least one of the antenna assemblies further includes a 2-axis tertiary deployment gimbal for affixing the third antenna to the second antenna. The first antenna and/or second antenna further comprise a reflector, an active array, or a center-fed antenna. The pair of antenna assemblies utilizes common launch restraints.

In the following description of the preferred embodiment, reference is made to the accompanying drawings that form a part thereof, and in which is shown by way of illustration a specific embodiment in which the invention may be practiced. It is to be understood that other embodiments may be utilized and changes may be made without departing from the scope of the present invention.

BRIEF DESCRIPTION OF THE DRAWINGS

Referring now to the drawings in which like reference numbers represent corresponding parts throughout.

DETAILED DESCRIPTION OF THE INVENTION

The present invention relates to an improved antenna stowage and deployment system for a spacecraft with more than two antennas, which allows for a plurality of antennas to be placed in the same location on a spacecraft, minimizing the volume of the system and reducing the number of necessary launch restraints.

Figure 1A:
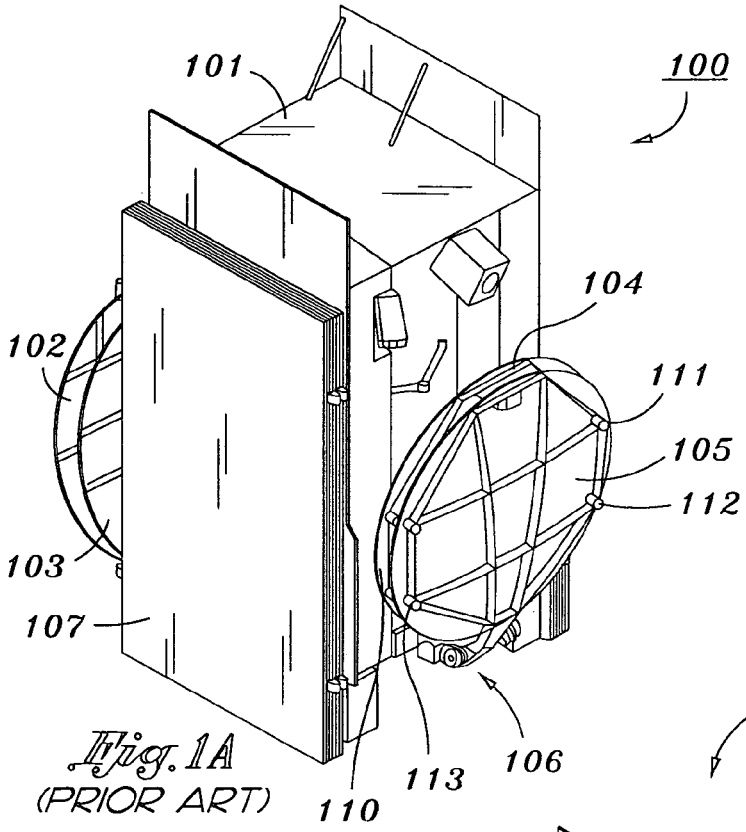
Fig. 1A (PRIOR ART)
FIGS. 1A and 1B depict a conventional antenna deployment and stowage system deployment hinge, in a stowed state and a deployed state, respectively.
Figure 1B:
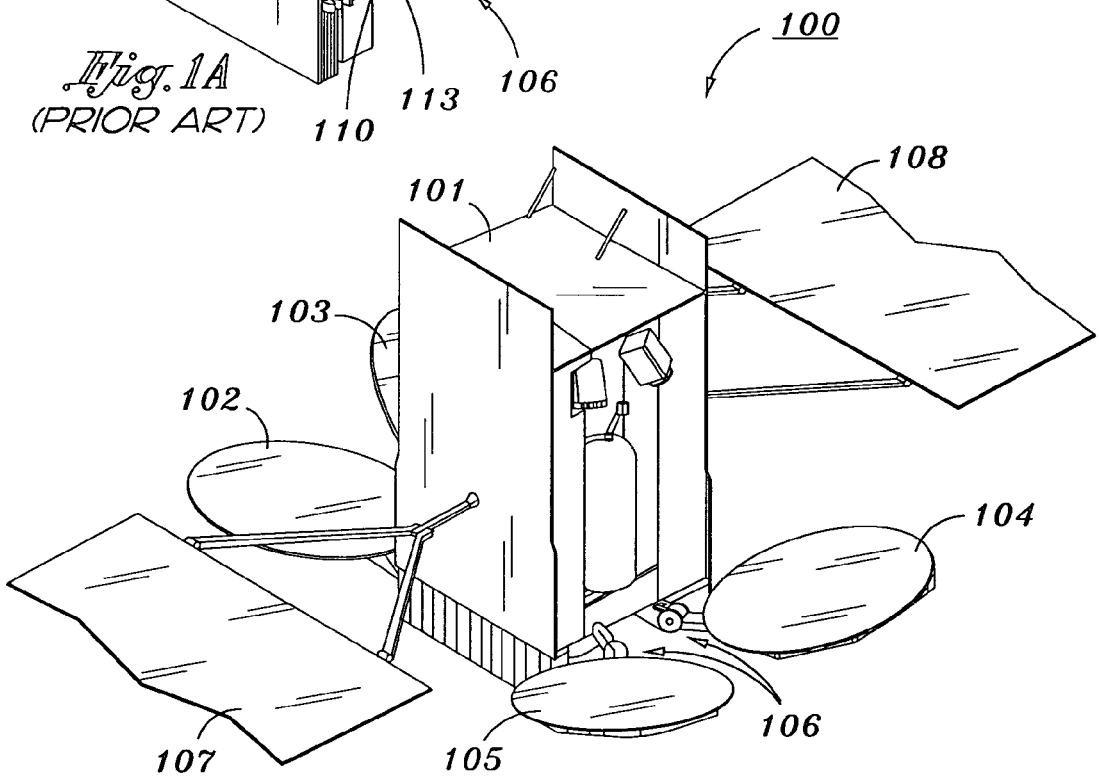
Fig. 1B (PRIOR ART)
Figure 2A:
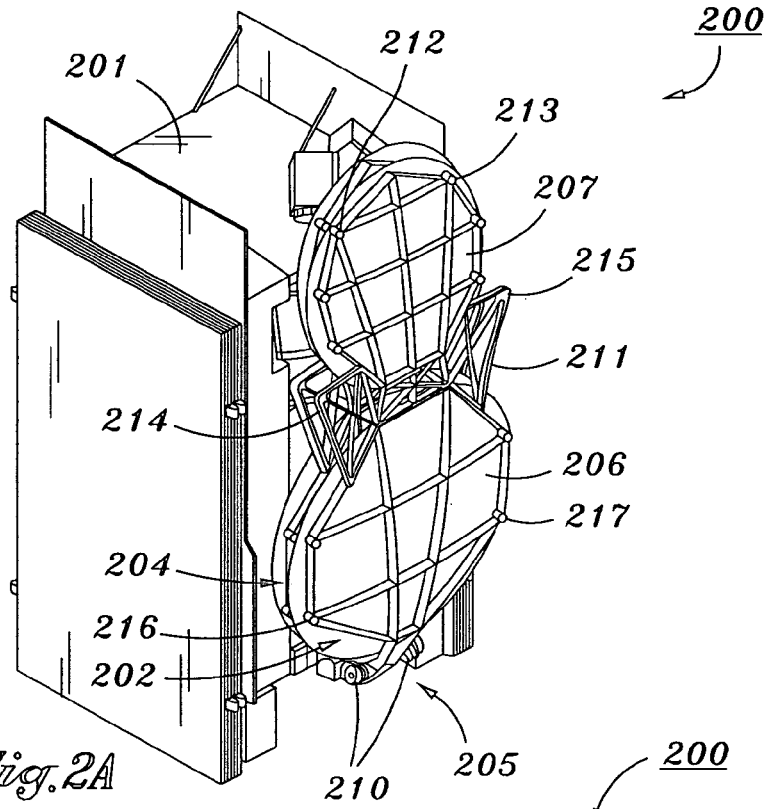
FIGS. 2A and 2B illustrate the enhanced antenna stowage and deployment system according to one embodiment of the present invention, in a state where the nested antenna assemblies are stowed and deployed, respectively.
Figure 2B:
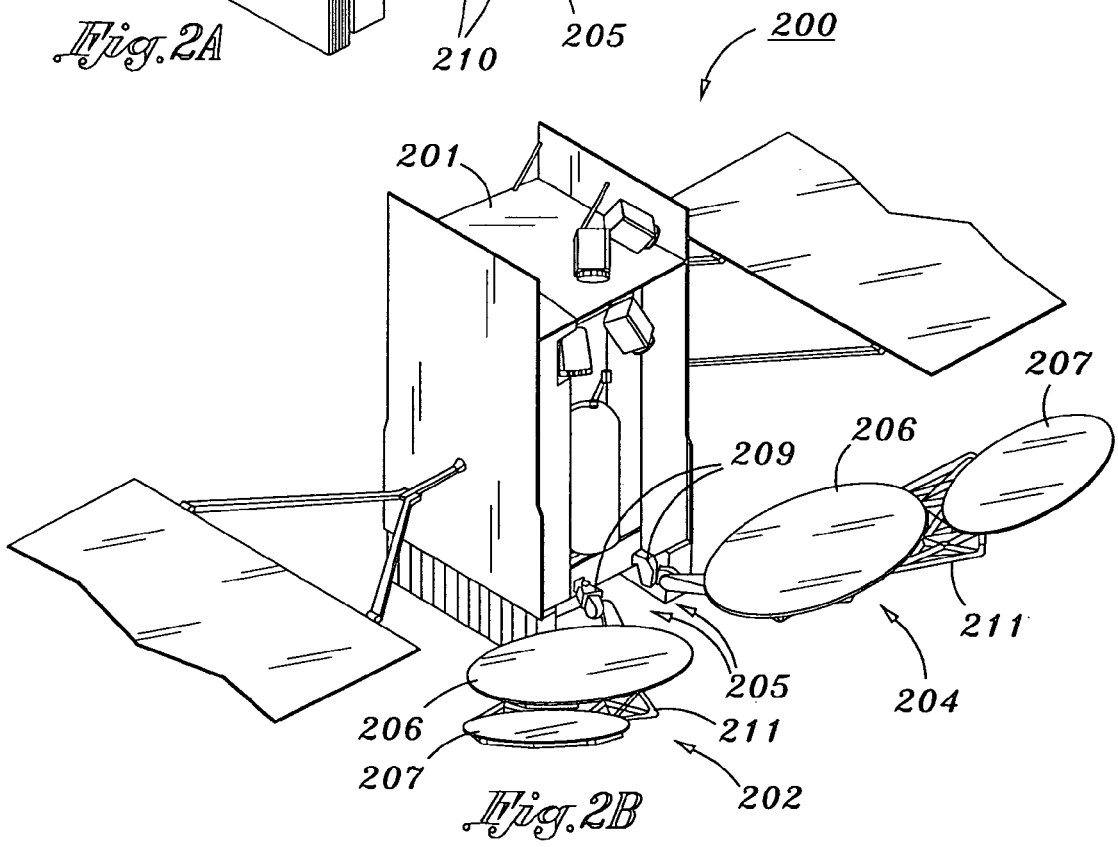

FIGS. 2A and 2B illustrate the enhanced antenna stowage and deployment system according to one embodiment of the present invention, in a state where the antenna assemblies are stowed and deployed, respectively. Briefly, the antenna stowage and deployment system according to this first example embodiment of present invention includes a spacecraft and at least one pair of adjacent nesting antenna assemblies. Each of the antenna assemblies further includes an articulating deployment couple affixed to the spacecraft for deploying the antenna assembly, a first antenna affixed to the deployment couple, and a second antenna affixed to the first antenna. At least one of the antenna assemblies further includes a rigid connecting structure for affixing the second antenna to the first antenna.

Deployable antennas and launch restraint subsystems are designed to increase the flexibility, configurability and capability of modern satellites. In this regard, the stowed state is a state in which launch restraints are restraining the antenna or antenna assembly in place for transport, and the deployment couple is in a volume-minimizing, retracted position. Since the antennas are often of similar shape, they are nested in the stowed state by permitting one antenna to fit inside another.

The deployed state is a state in which the launch restraints have been removed, and the antenna or antenna assembly has been moved from the stowed position and oriented in its operational location by fully articulating the deployment couple. A transitory deploying state in between the stowed state and the deployed state is also contemplated, but illustration of this state is not necessary for the purpose of understanding the features of the present invention.

With regard to a detailed description of the embodiment depicted in FIGS. 2A and 2B however, antenna stowage and deployment system 200 includes spacecraft 201 and adjacent nesting antenna assemblies 202 and 204. Antenna assemblies 202 and 204 each further respectively include articulating deployment couple 205 affixed to spacecraft 201 for deploying each of antenna assemblies 202 and 204, first antenna 206 affixed to deployment couple 205, and second antenna 207 affixed to first antenna 206.

The enhanced antenna stowage and deployment system according to the present invention permits the separation and orientation of more than two adjacent antennas which require an extremely precise deployed position relative to a main spacecraft body. In this regard, deployment couple 205 further includes 1-axis separating hinge 209 and 2-axis primary deployment gimbal 210.

Since the purpose of deployment couple 205 is to deploy each of the nested antenna assemblies, the appropriate size, tolerances, arrangement, type and design of deployment couple 205 depends on several factors, including aperture size, number and type of antennas on each antenna assembly, spacecraft size, type, design, or material, or any number of other factors. As such, in certain simple arrangements, deployment couple 205 includes a single 1-axis separating hinge only, in order to effectively separate and deploy corresponding antenna assemblies using a single 1-axis motion. In other arrangements, deployment couple 205 includes a single 2-axis primary deployment gimbal only, deploying and orienting the antenna assemblies in a more complex 2-axis motion.

In further arrangements, deployment couple 205 includes a combination of a 1-axis separating hinge or hinges as well as a 2-axis primary deployment gimbal or gimbals affixed to the first antenna side of the antenna assembly. Using a compound separating hinge and primary deployment gimbal deployment couple, the antenna stowage and deployment system according to the present invention effectuates an initial separation motion (using the 1-axis separating hinge) followed by a deployment maneuver once the nested antenna assemblies have been separated (using the 2-axis primary deployment gimbal). The articulation of deployment couple 205 can also be effectuated using apparatus other than 1-axis separating hinges and 2-axis deployment gimbals, and these apparatus or means are also contemplated by the present invention.

Antenna assembly 202 and/or antenna assembly 204 further include a rigid connecting structure 211 for affixing second antenna 207 to first antenna 206. By interposing rigid connecting structure 211 between first antenna 206 and second antenna 207, deployment couple 205 is able to simultaneously control the deployment and orientation of all antennas on each antenna assembly. First antenna 206 and/or second antenna 207 further comprise a reflector, an active array, center-fed antenna or other type of antenna known in the art.

The pair of antenna assemblies utilizes common launch restraints, located at common launch restraint locations 212 to 217. In the previously described conventional antenna stowage and deployment system, the array of four antennas required a total of eight launch restraints, with four launch restraints located on each of two obverse sides of spacecraft 101. Using the enhanced antenna stowage and deployment system according to the embodiment of present invention illustrated in FIGS. 2A and 2B, however, only six lunch restraints are used for an array of four antennas, and all six launch restraints are adjacent and located on the same side of spacecraft 201. This co-location and consolidation reduces the weight and volume of spacecraft 202 by reducing the number of necessary launch restraints and launch restraint severing mechanisms, thereby increasing overall mission capabilities.

In effect, antenna stowage and deployment system 200 affixes a rigidly mounted antenna to another 2-axis primary gimbaled antenna's support structure, stowing a paired assembly in a nested manner with another paired assembly. This arrangement produces a four-antenna, nested package that utilizes common launch restraints, thereby minimizing the volume necessary for stowing on a launch vehicle. Each paired antenna assembly may utilize its 2-axis primary deployment gimbal for deployment, and a separate 1-axis hinge to separate and orient the assemblies on orbit.

Figure 3A:
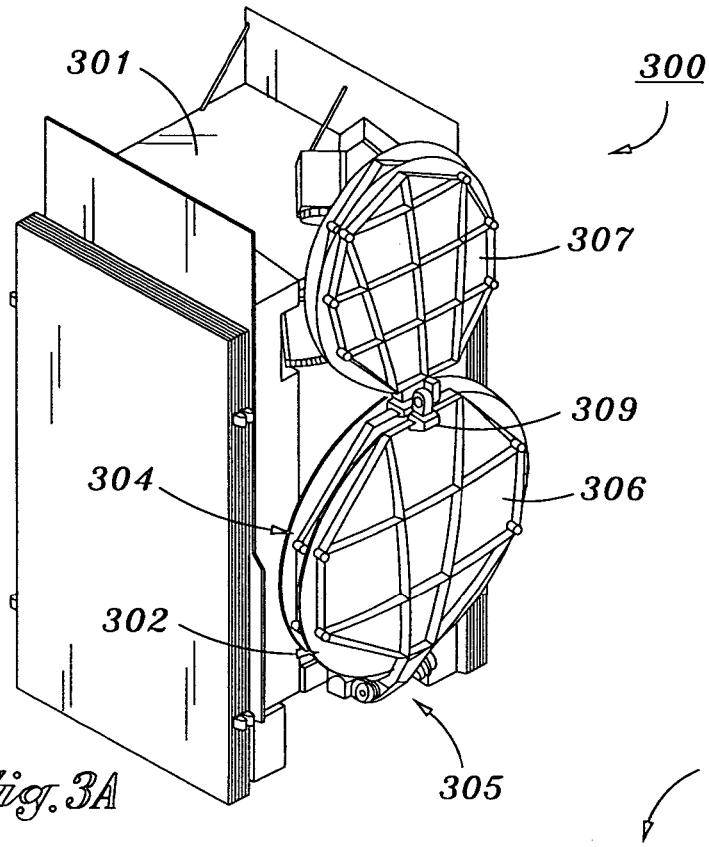
FIGS. 3A and 3B illustrate the enhanced antenna stowage and deployment system according to a second embodiment of the present invention, in a state where the nested antenna assemblies are stowed and deployed, respectively.
Figure 3B:
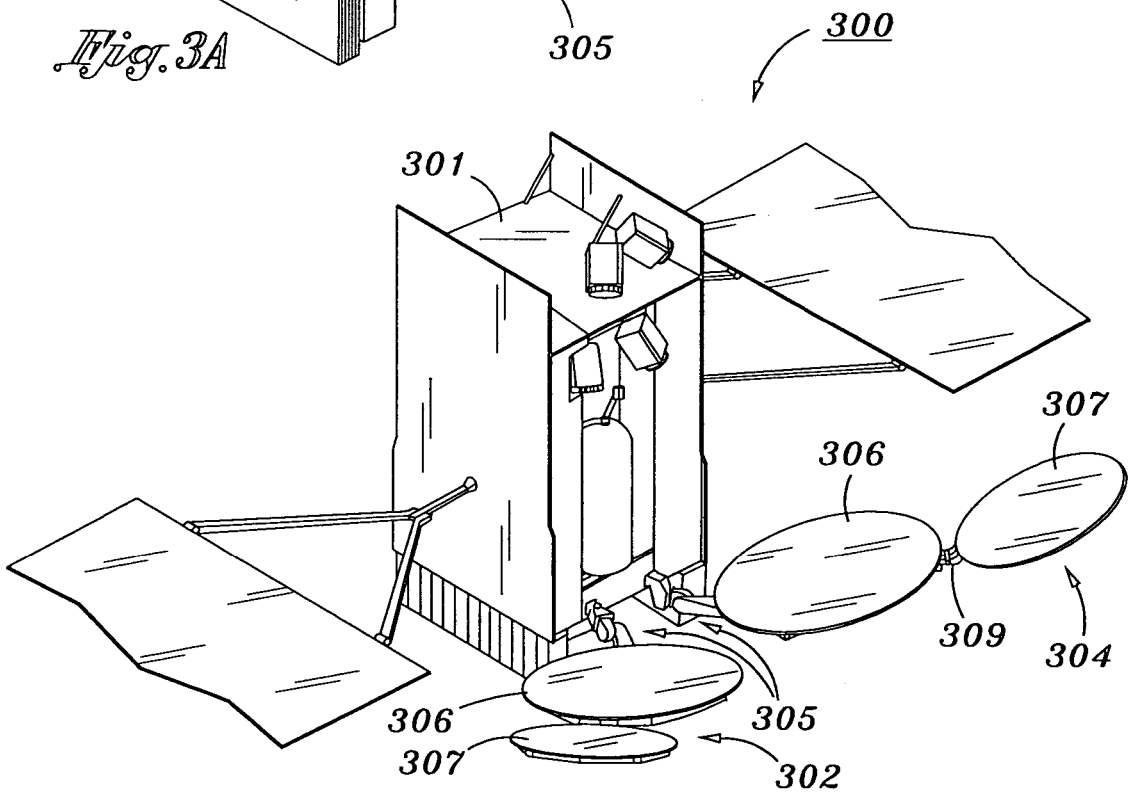

FIGS. 3A and 3B illustrate the enhanced antenna stowage and deployment system according to a second embodiment of the present invention, in a state where the antenna assemblies are stowed and deployed, respectively. Briefly, the third embodiment of the enhanced antenna stowage and deployment system includes a spacecraft and at least one pair of adjacent nesting antenna assemblies. Each of the antenna assemblies further includes an articulating deployment couple affixed to the spacecraft for deploying the antenna assembly, a first antenna affixed to the deployment couple, and a second antenna affixed to the first antenna. At least one of the antenna assemblies further includes a 2-axis secondary deployment gimbal for affixing the second antenna to the first antenna.

The enhanced antenna stowage and deployment system depicted in FIGS. 3A and 3B is somewhat similar to the one shown in FIGS. 2A and 2B. The FIGS. 3A and 3B embodiment discloses a 2-axis secondary deployment gimbal for affixing the second antenna to the first antenna instead of a rigid connecting structure.

In more detail, enhanced antenna stowage and deployment system 300 includes spacecraft 301 and adjacent nesting antenna assemblies 302 and 304. Antenna assemblies 302 and 304 each further include articulating deployment couple 305 affixed to spacecraft 301 for deploying each of antenna assemblies 302 and 304, first antenna 306 affixed to deployment couple 305, and second antenna 307 affixed to first antenna 306.

Since enhanced antenna stowage and deployment system 300 permits the precise separation, deployment and orientation of more than two adjacent antennas, deployment couple 305 further includes a 1-axis separating hinge and/or a 2-axis primary deployment gimbal. As indicated above, the design and arrangement of deployment couple 305 is highly dependant on aperture size, number and type of antennas on each antenna assembly, or other factors such as spacecraft size, type, design or material.

At least one of the antenna assemblies further includes secondary deployment gimbal 309 for affixing second antenna 307 to the first antenna 306. First antenna 306 and/or second antenna 307 further comprises a reflector, an active array, or a center-fed antenna. The pair of antenna assemblies utilizes common launch restraints. As such, antenna stowage and deployment system 300 mounts a 2-axis secondary deployment gimbaled antenna to another 2-axis primary gimbaled antenna's support structure, stowing a paired assembly in a nested manner with another paired assembly, producing a four-antenna, nested package that utilizes common launch restraints, thereby minimizing the volume necessary for stowing on a launch vehicle. Each paired antenna assembly utilizes one of its 2-axis gimbals for deployment, and a separate 1-axis hinge to separate and orient the assemblies on orbit.

Figure 4:
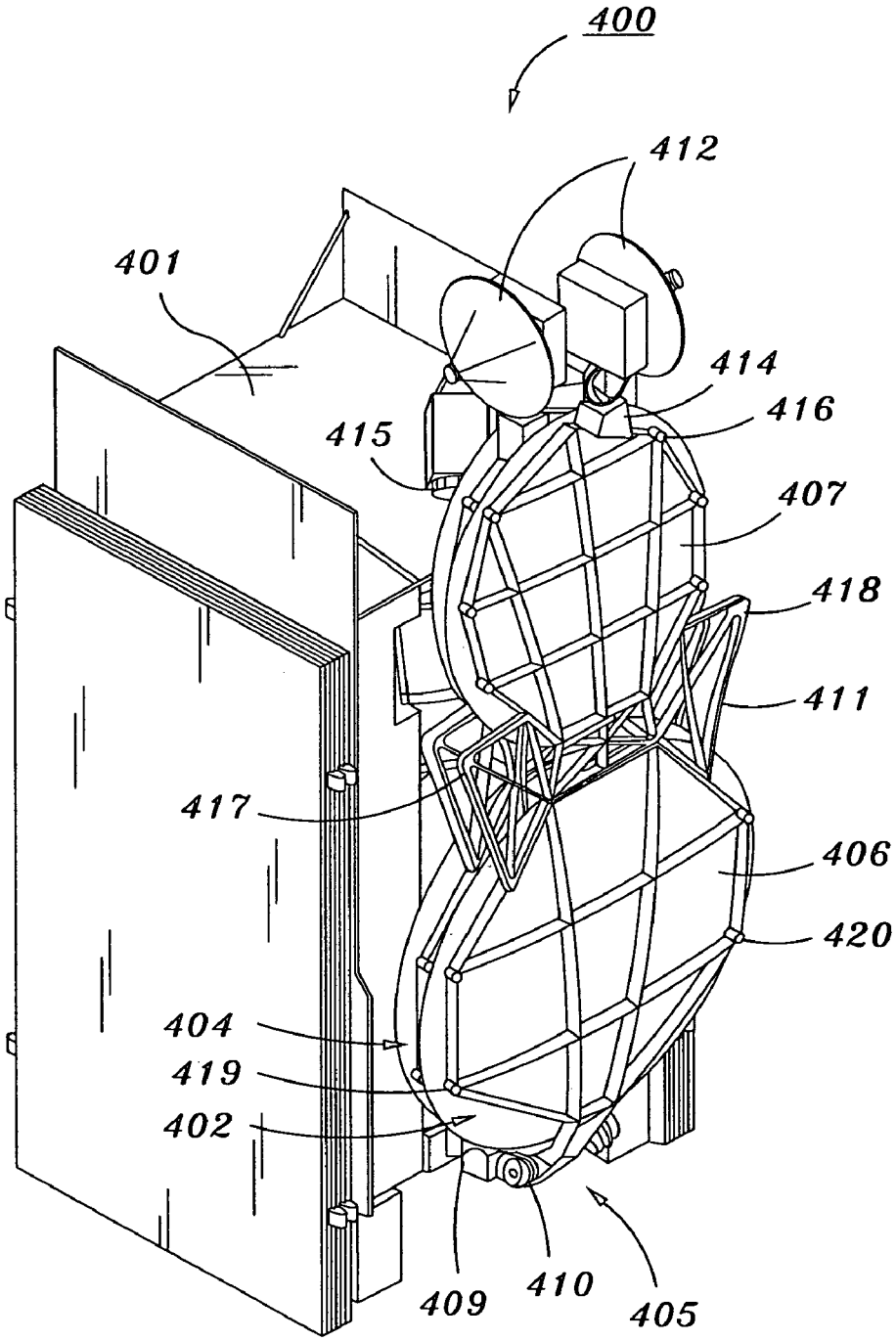
FIG. 4 illustrates the enhanced antenna stowage and deployment system according to a third embodiment of the present invention, in a state where the nested antenna assemblies are stowed.

FIG. 4 illustrates the enhanced antenna stowage and deployment system according to a third embodiment of the present invention, in a state where the antenna assemblies are stowed. Briefly, the third example embodiment of the present invention is an antenna stowage and deployment system, including a spacecraft and at least one pair of adjacent nesting antenna assemblies. Each of the antenna assemblies further includes an articulating deployment couple affixed to the spacecraft for deploying the antenna assembly, a first antenna affixed to the deployment couple, and a second antenna affixed to the first antenna. At least one of the antenna assemblies further includes a 2-axis secondary deployment gimbal or a rigid connecting structure for affixing the second antenna to the first antenna. At least one of the antenna assemblies further includes a third antenna affixed to the second antenna, where the third antenna comprises a center-fed antenna, and where the at least one of the antenna assemblies further includes a 2-axis tertiary deployment gimbal for affixing the third antenna to the second antenna.

The enhanced antenna stowage and deployment system depicted in FIG. 4 is somewhat similar to that shown in FIGS. 3A and 3B, with the exception that, with the FIG. 4 system, a 2-axis tertiary deployment gimbal is affixing to the second antenna, and a third, center-fed antenna is affixed to the tertiary deployment gimbal.

In more detail, antenna stowage and deployment system 400 includes spacecraft 401 and adjacent nesting antenna assemblies 402 and 404. Antenna assemblies 402 and 404 each further include articulating deployment couple 405 affixed to spacecraft 401 for deploying each of antenna assemblies 402 and 404, first antenna 406 affixed to deployment couple 405, and second antenna 407 affixed to first antenna 406.

The enhanced antenna stowage and deployment system according to this embodiment of the present invention permits the separation and orientation of six antennas which require an extremely precise deployed position relative to a main spacecraft body. As such, deployment couple 405 further includes 1-axis separating hinge 409 and/or 2-axis primary deployment gimbal 410, and at least one of the antenna assemblies further includes rigid connecting structure 411 for affixing second antenna 407 to first antenna 406. Although the FIG. 4 embodiment depicts a rigid connecting structure for affixing second antenna 407 to first antenna 406, in a further non-illustrated arrangement second antenna 407 is affixed to first antenna 406 using a secondary deployment gimbal.

At least one of antenna assembly 402 and/or antenna assembly 404 further includes third antenna 412 affixed to second antenna 407, where third antenna 412 comprises a center-fed antenna. The at least one of antenna assemblies 402 and/or 404 further includes 2-axis tertiary deployment gimbal 414 for affixing third antenna 407 to second antenna 406. First antenna 406 and/or second antenna 407 further comprise a reflector, an active array, or a center-fed antenna. Pair of antenna assemblies 402 and 404 utilize common launch restraints, including common launch restraints 415 to 420.

The example embodiment of the present invention depicted in FIG. 4 provides additional gimbaled, center-fed antennas, to the rigidly-coupled or gimbaled pair of antennas, thereby creating a pair of three-antenna packages. The center-fed antennas are particularly well suited for inter-satellite links.

Typical nested reflected designs merely package a total of two antennas, and conventional designs with more than two antennas require the antennas to be stowed and deployed from different locations on the spacecraft. The enhanced antenna stowage and deployment system according to the present invention minimizes the volume necessary for the packaging of four or more antennas on a spacecraft, while minimizing the launch restraints necessary to package them, increasing the possible number of antennas packaged on the spacecraft.

The invention has been described with particular illustrative embodiments. It is to be understood that the invention is not limited to the above-described embodiments and that various changes and modifications may be made by those of ordinary skill in the art without departing from the spirit and scope of the invention.

What is claimed is:

1. An antenna stowage and deployment system, comprising:

a spacecraft;

at least a first and a second antenna assembly, wherein the at least first antenna assembly and the second antenna assembly are located along the same surface of said spacecraft, and wherein, in a non-deployed state, the second antenna assembly is configured to nest upon the first antenna assembly, each of said antenna assemblies further comprising:

an articulating deployment couple affixed to said spacecraft for deploying said antenna assembly, a first antenna affixed to said deployment couple, and a second antenna affixed to said first antenna.

2. An antenna stowage and deployment system according to claim 1, wherein said deployment couple further comprises a 1-axis separating hinge and/or a 2-axis primary deployment gimbal.

3. An antenna stowage and deployment system according to claim 1, wherein at least one of said antenna assemblies further comprises a 2-axis secondary deployment gimbal for affixing said second antenna to said first antenna.

4. An antenna stowage and deployment system according to claim 1, wherein at least one of said antenna assemblies further comprises a rigid connecting structure for affixing said second antenna to said first antenna.

5. An antenna stowage and deployment system according to claim 1, wherein at least one of said antenna assemblies further comprises a third antenna affixed to said second antenna.

6. An antenna stowage and deployment system according to claim 5, wherein said third antenna comprises a center-fed antenna.

7. An antenna stowage and deployment system according to claim 5, wherein the at least one of said antenna assemblies further comprises a 2-axis tertiary deployment gimbal for affixing said third antenna to said second antenna.

8. An antenna stowage and deployment system according to claim 1, wherein said first antenna further comprises a reflector.

9. An antenna stowage and deployment system according to claim 1, wherein said first antenna further comprises an active array.

10. An antenna stowage and deployment system according to claim 1, wherein said first antenna further comprises a center-fed antenna.

11. An antenna stowage and deployment system according to claim 1, wherein said second antenna further comprises a reflector.

12. An antenna stowage and deployment system according to claim 1, wherein said second antenna further comprises an active array.

13. An antenna stowage and deployment system according to claim 1, wherein said second antenna further comprises a center-fed antenna.

14. An antenna stowage and deployment system according to claim 1, wherein said at least first and second antenna assemblies utilizes common launch restraints.

* * * * *